US005757935A

United States Patent [19]

Kang et al.

[11] Patent Number: 5,757,935

[45] Date of Patent: May 26, 1998

[54] AUDIO LISTENING DEVICE FOR THE HEARING IMPAIRED

[75] Inventors: Seong Hoon Kang; Kyeong Ok Kang, both of Daejeon, Rep. of Korea

[73] Assignee: Electronics and Telecommunications Research Institute, Daejeon, Rep. of Korea

[21] Appl. No.: 895,899

[22] Filed: Jul. 17, 1997

Related U.S. Application Data

[63] Continuation-in-part of Ser. No. 609,866, Mar. 1, 1996.

[51] Int. Cl.[6] ..... H04R 25/00

[52] U.S. Cl. ..... 381/68.3; 381/23.1; 381/151

[58] Field of Search ..... 381/68, 68.3, 68.7, 381/150, 151, 23.1, 68.6

[56] References Cited

U.S. PATENT DOCUMENTS

| | | | |
|---|---|---|---|
| 1,969,559 | 8/1934 | Kelly | 381/68.3 |
| 2,832,842 | 4/1958 | Knauert | 381/68.3 |
| 4,612,915 | 9/1986 | Hough et al. | 381/68.3 |
| 4,750,208 | 6/1988 | Yamada et al. | 381/151 |
| 4,791,673 | 12/1988 | Schreiber . | |
| 4,821,323 | 4/1989 | Papiernik | 381/68.3 |
| 4,843,628 | 6/1989 | Hofer | 381/151 |
| 5,295,193 | 3/1994 | Ono | 381/68.3 |
| 5,323,468 | 6/1994 | Bottesch . | |
| 5,511,132 | 4/1996 | Yoshimi | 381/68.3 |

FOREIGN PATENT DOCUMENTS

| | | | |
|---|---|---|---|
| 2707038 | 8/1978 | Germany | 381/68.3 |

*Primary Examiner*—Curtis Kuntz
*Assistant Examiner*—Xu Mei
*Attorney, Agent, or Firm*—Spencer & Frank

[57] ABSTRACT

An audio listening device includes a circuit for amplifying sound source signals and a mechanism including a bone conduction vibrator transforming an output signal of the amplifying circuit into a vibration. A vibration source transforms the output of the amplifying circuit into a first magnetic field and vibration. A vibration generating unit generates a second magnetic field for the vibration source to vibrate upwards and downwards due to attraction and repulsion processes of the first and second magnetic fields. A damper is connected to the vibration source to arouse air conduction hearing due to the vibration of the vibration source. A vibration plate is connected to the vibration source to arouse a bone conduction hearing due to the vibration of the vibration source. A vibration transmission unit transmits the bone conduction hearing and air conduction hearing to the hearing impaired.

13 Claims, 2 Drawing Sheets

AUDIO LISTENING DEVICE FOR THE HEARING IMPAIRED

This application is a Continuation-In-Part of application Ser. No. 08/609,866, filed Mar. 1, 1996.

BACKGROUND OF THE INVENTION

1. Field of the Invention

The present invention relates to an audio listening device which enables the hearing impaired to appreciate music signals by transforming soundwaves into vibration, and more particularly to an audio listening device for the hearing impaired having a serious obstacle to the path of the air conduction lying between the outer ear and the middle ear, with which the hearing impaired can receive stereo sonic high frequency signals above 200 Hz through bone conduction headphones using bone conduction hearing, and stereo sonic low frequency signals below 200 Hz through an existing spine vibration sheet using bone conduction hearing.

2. Description of Prior Art

An existing spine vibration device, composed of a vibration sheet, is devised for the non-impaired to receive low frequency signals by using the vibration of their spines transmitted from the spine vibration device, while they appreciate music signals by using air conduction hearing with the help of loudspeakers or headphones in their houses or cars.

However, the hearing impaired, having a serious obstacle to the path of the air conduction lying between the outer ear and the middle ear, have only been able to appreciate a low frequency component of music signals by using the vibration of their spines because the soundwaves from loudspeakers or headphones rarely reach their sensorineural system.

Furthermore, although the existing bone conduction vibrator can be substituted for loudspeakers or headphones, the hearing impaired can not hear the music signal due to the fact that the existing bone conduction vibrator is mainly designed for receiving voice signals whose frequency bandwidth is highly limited, and other problems come from the fact that neither the hearing impaired nor non-impaired can use the existing device together as it is designed for only bone conduction hearing.

SUMMARY OF THE INVENTION

Therefore, to solve the above mentioned problems, the purpose of the present invention is to provide an audio listening device for the hearing impaired which consists of bone conduction headphones fitted with a bone conduction vibrator using the principle of an ordinary loudspeaker, the loudspeaker unit and vibration plate to hear acoustic signals with broader frequency bandwidth by way of bone conduction and air conduction hearing, and consisting of the existing spine vibration system fitted with a vibration sheet. Accordingly, both the impaired and non-impaired can hear high frequency components of music signals through bone conduction headphones, resulting in the intelligibility reinforcement of music signals, and low frequency components of music signals through the existing vibration sheet to increase the naturality of music signals, respectively.

To accomplish the above mentioned purpose, the present invention is comprised of the following: a first means for amplifying external stereo sound signals to the predetermined level; a second means having a bone conduction vibrator which transforms directly the output signal of the first means into vibration so as to hear sound siganls by air conduction as well as bone conduction hearing; a third means for amplifying external stereo sound signals through a mixer/signal processor and a low pass filter; and a fourth means for transforming the output signal of the third means into vibration so as to arouse bone conduction hearing on the spine.

DETAILED DESCRIPTION OF THE PREFERRED EMBODIMENT

The present invention will be described with reference to the embodiment illustrated in the accompanying drawings.

Figure 1:
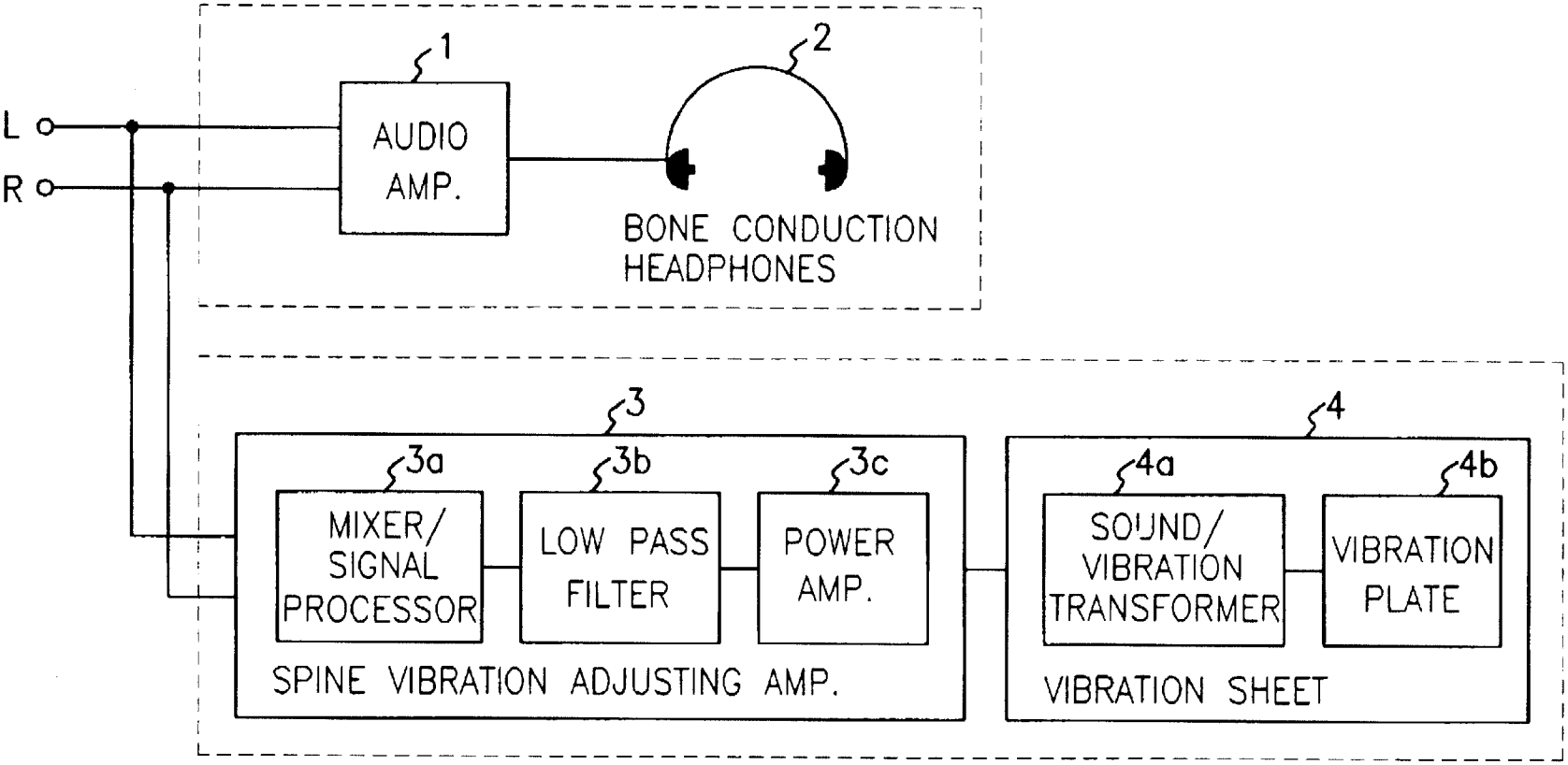
FIG. 1 is a block diagram illustrating the overall configuration of the present invention.

Referring to the accompanying drawings, FIG. 1 illustrates an audio listening device for hearing impaired which includes an audio amplifier 1, bone conduction headphones 2, a spine vibration adjusting amplifier 3 including a mixer/signal processor 3*a*, a low pass filter 3*b* and a power amplifier 3*c*, and a vibration sheet 4 including a sound/vibration transformer 4*a* and a vibration plate 4*b*.

Figure 2:
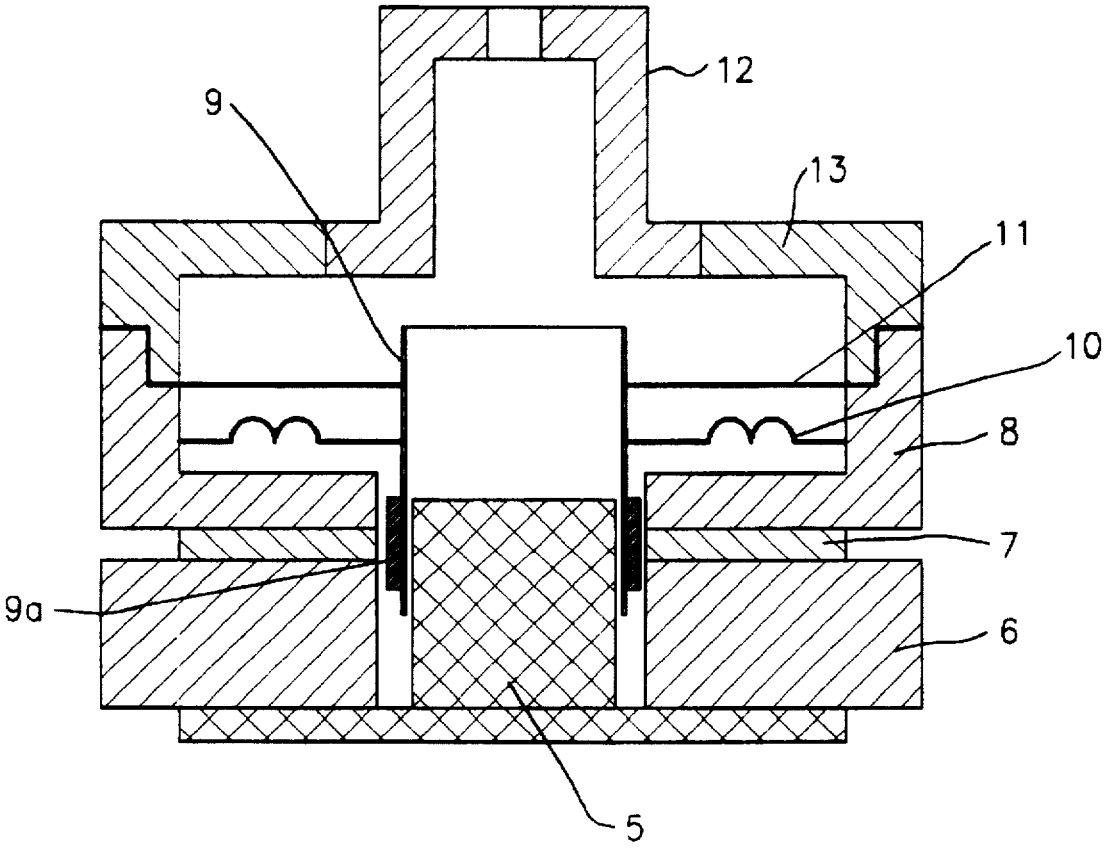
FIG. 2 is a cross-sectional view of the bone conduction vibrator.

FIG. 2 illustrates the bone conduction vibrator which includes a lower core 5, an electromagnet 6, the upper plate 7, a frame 8, a bobbin 9, a bobbin coil 9*a*, a damper 10, a vibration plate 11, a vibration contact part 12 and a coverlet 13. The present invention comprises the bone conduction headphones listening system adopting the principle of an ordinary loudspeaker in order to hear sound signals by air conduction hearing as well as bone conduction hearing, and a spine vibration system composed of the spine vibration adjusting amplifier 3 and the vibration sheet 4.

As illustrated in FIG. 1, the output signal of the audio amplifier, which amplifies applied external sound signals, is transmitted to the bone conduction headphones so that the hearing impaired and non-impaired cain hear the sound signal. The bone conduction headphones adopts the bone conduction vibrator as a drive in order to directly transform the applied sound signal into vibration, and also adopts the principle of an ordinary loudspeaker.

Consequently, the hearing impaired and non-impaired can hear the sound signals by both bone conduction and air conduction hearing.

On the other hand, the spine vibration system has two main parts. The first part is the spine vibration adjusting amplifier 3 comprising the mixer/signal processor 3*a*, for processing external signals, the low pass filter 3*b*, for passing only low frequency components among the output signals from the mixer/processor 3*a*, and the power amplifier 3*c*, for amplifying low frequency signals passing through the low pass filter 3*b*. The second part is the vibration sheet 4 comprising the sound/vibration transformer 4*a* and the vibration plate 4*b*, for transforming the output signal of the spine vibration adjusting amplifier 3 into vibration in order to arouse the bone conduction hearing sense on the spine.

Consequently, the hearing impaired can appreciate the low frequency component of music signals of which characteristic is dynamic and natural.

Referring to FIG. 2, the configuration of the bone conduction vibrator will be described below:

The bobbin coil 9a, which cain transform sound signals into a magnetic field, is wound around the cylindrical bobbin 9 perforated through the upper and lower parts so that the process of attraction or repulsion against the magnetic field of the fixed magnet can take place.

The impedance of the bobbin coil is matched with that of the already fixed vibrator.

The lower core 5, the electromagnet 6 and the upper plate 7 sequentially combined with the inside and outside of the bobbin 9 make the magnetic circuit for the bobbin 9 to move up and down together with the bobbin coil 9a.

The fixed magnet composed of the lower core 5, the electromagnet 6 and the upper plate 7 adopts the principle of an ordinary loudspeaker in order to reinforce the air conduction hearing, and also uses a small sized loudspeaker unit so as to appreciate the music signals having a broader frequency bandwidth than the voice signals.

Also, the fixed magnet is designed to have little flux leakage to maintain smooth vibration of the bobbin coil 9a at the gap between the lower core 5 and the electromagnet 6, and to narrow the gap for high efficiency of the magnetic circuit.

The frame 8, having a step-shaped part at its inside, is laid on the upper plate 7. The damper 10 and the vibration plate 11 are installed around the surface of the bobbin 9 with some interval between each other. The damper 10, supported on the frame 8, is used for reinforcing the air vibration for air conduction hearing resulting from the bobbin 9. The cross-shaped vibration plate 11, supported on the frame 8, keeps the air vibration of the damper 10 stable, and also arouses bone conduction hearing by vibrating up and down owing to the vibration of the bobbin 9 and the bobbin coil 9a.

As mentioned above, the overall vibration system consists of the bobbin 9, the bobbin coil 9a, the damper 10, and the vibration plate 11. The overall vibration system is supported by the frame 8 and covered with the coverlet 13 in order to keep the overall vibration, including the vibration of the vibration plate 11, stable.

On the other hand, the vibration contact part 12, forming a gap on its central axis, considering the efficiency of air conduction hearing from the vibration of the damper 10 as well as bone conduction hearing, is laid on the outer surface of the bobbin 9, and can be positioned after deciding the height and the curvature taking into account the contact surface with the face.

The bobbin 9 is supported and installed through the damper 10 and the vibration plate 11 in a space formed by the coverlet 13 and the frame 8, such that the bobbin 9 is spaced out at a predetermined distance from the bottom of the vibration contact part 12 and can be vibrated up and down. Therefore there is formed a path through which air medium can pass to the central gap of the vibration contract part 12 between the upper end of the bobbin 9 and the bottom of the vibration contact part 12. Sound waves (that is, air vibration generated by the vibration of the damper 10) can then be conveyed through the path toward the central gap of the vibration contact part 12, thus arousing air conduction hearing. As the bobbin 9 is supported at the frame 8 through the damper 10 and the vibration plate 11, the vibration of the damper 10 may also contribute to some extent to a bone conduction hearing together with the vibration plate 11.

The working flow of the bone conduction vibrator will be described as follows:

When external sound signals are applied to the bobbin coil 9a, a magnetic field is generated by the current flowing in the bobbin coil 9a. Due to both this magnetic field and another magnetic field generated from the fixed magnet comprising the lower core 5, the electromagnet 6 and the upper plate 7, attraction and repulsion process of two magnetic fields take place. Accordingly, the bobbin 9, wound by the bobbin coil 9a, moves up and down within the gap of the magnetic circuit. Subsequently, the cross-shaped vibration plate 11 vibrates and transmits its vibration to the vibration contact part 12 in order to arouse bone conduction hearing.

On the other hand, the vibration of the bobbin 9 causes the damper 10 to reinforce its air vibration which is able to arouse air conduction hearing by way of the vibration contact part 12. At this time, the frame 8 and the coverlet 13 keep the overall vibration of the damper 10 and the vibration plate 11, which results from the vibration of the bobbin 9, stable.

Therefore, the high frequency component of the music signals transmitted from the audio amplifier 1 can be heard by using the bone conduction headphones 2 having the bone conduction vibrator.

In other words, the overall working flow of the present invention is as follows:

At first, external stereo sound signals amplified by the audio amplifier 1 are transmitted to the bone conduction headphones 2 fitted with left and right bone conduction vibrators. When, the bone conduction vibrator follows the above mentioned working flow and, consequently, can arouse air conduction as well as bone conduction hearing.

Accordingly, in case the hearing impaired wear the bone conduction headphone 2 so that the vibration contact part 12 of the bone conduction vibrator is positioned exactly at the optimum contact point on the face they are able to hear stereo sounds signals by bone conduction hearing. Furthermore, in case the non-impaired wear the headphones on their ears just like ordinary-headphones, they can also hear stereo sound signals through air conduction hearing.

Also, in case external stereo signals are applied to the spine vibration adjusting amplifier 3 consisting of the mixer/signal processor, the output signal has a low frequency component. Then, the output signals are transmitted to the sound/vibration transformer 4a in which the sound signals are transformed into vibration for vibrating the vibration sheet 4b.

The effect of the present invention is described below:

The bone conduction headphones 2 gives the hearing impaired the clearness, in other words, high frequency characteristics of music signals by using the bone conduction hearing sense at the skull. On the other hand, the vibration sheet 4 gives dynamic and natural characteristics of a low frequency component to the hearing impaired by using bone conduction hearing sense at the spine.

Therefore, the hearing impaired can use the present invention as a music appreciation system because the bone conduction headphones 2 are fit for the broadband frequency signal such as TV or radio signals.

Moreover, the non-impaired can also use the present invention because the bone conduction headphones 2 adopt the priniciple of an ordinary loudspeaker.

What is claimed is:

1. An audio listening device for the hearing impaired, comprising:

first means for amplifying sound source signals; and second means having a bone conduction vibrator transforming an output signal from said first means into vibration, said second means including:

a vibration source for transforming the output of said first means into a first magnetic field;

a housing having an inner wall surface and providing an inner space accommodating said vibration source;

vibration generating means for generating a second magnetic field for said vibration source to vibrate upwards and downwards due to attraction and repulsion processes of the first and second magnetic fields from said vibration source and said vibration generating means, respectively;

a damper connecting and supporting said vibration source to the inner wall surface of the housing so that said vibration source can vibrate up and down in said housing, said damper generating air vibration for air conduction hearing in response to vibration of said vibration source;

a vibration plate connecting and supporting said vibration source to the inner wall surface of the housing together with said damper and arousing vibration for bone conduction hearing in response to the vibration of said vibration source; and a vibration transmission means for transmitting the bone conduction hearing and the air conduction hearing to the hearing impaired.

2. An audio listening device in accordance with claim 1, wherein said housing comprises:

a frame having a lower base formed with a central opening and a wall extending upward from an edge of the base, said vibration source being supported at an inner surface of the wall by the damper and the vibration plate such that a lower end of the vibration source can extend through said central opening; and a coverlet having an upper surface formed with an opening and a wall extending downward from an edge of the upper surface, said coverlet constituting the vibration transmission means.

3. An audio listening device in accordance with claim 1, wherein said vibration source comprises:

a cylindrical bobbin which is perforated through its upper and lower part; and a voice coil which is wound around the lower and outer surface of said cylindrical bobbin.

4. An audio listening device in accordance with claim 3, wherein said vibration generating means comprises:

a lower core which is inserted toward a lower inside of said cylindrical bobbin;

an electromagnet installed outside of said cylindrical bobbin and defining a first gap with said lower core; and an upper plate laid on said electromagnet and defining a second gap with said lower core, which is about the same size as the first gap.

5. An audio listening device in accordance with claim 3, wherein said damper is a disc-shaped plate member having a central perforation where the bobbin is fitted and secured.

6. An audio listening device in accordance with claim 3, wherein said vibration plate is a cross-shaped plate member having a central perforation where said bobbin is fitted and secured.

7. An audio listening device in accordance with claim 1, wherein said vibration generating means comprises a magnetic circuit, and has a gap within which said vibration source can vibrate.

8. An audio listening device in accordance with claim 1, wherein said vibration transmission means has a centralized gap disposed above the vibration source and through which air vibration generated by said damper passes.

9. An audio listening device in accordance with claim 1, wherein said device further comprises:

a third means for amplifying sound source signals through a mixer/signal processor and a low pass filter; and a fourth means for transforming the output signal of said third means into vibration so as to arouse a bone conduction hearing on the spine.

10. An audio listening device for the hearing impaired, said device comprising:

first means for amplifying acoustic signals received from an exterior; and second means comprising a bone conduction vibrator and an air conduction vibrator, which includes:

a vibration source for generating a first magnetic field from an output of said first means;

a housing providing an inner space where said vibration source is accommodated;

vibration generating means for generating a second magnetic field for said vibration source to be vibrated upwards and downwards;

bone conduction vibrating means connecting and supporting said vibration source to an inner wall of said housing for transmitting the vibration of said vibration source directly to the wall of said housing; and air conduction vibrating means contacting and supporting said vibration source to the wall of said housing together with said bone conduction vibrating means for causing air vibration in response to vibration of said vibration source;

whereby said device provides the hearing impaired with bone conduction hearing and air conduction hearing.

11. An audio listening device in accordance with claim 10, wherein said housing includes:

a frame having a lower base formed with a central opening and a wall extending upward from an edge of the base, said vibration source being supported on an inner surface of the wall by said damper and said vibration plate; and a coverlet having an upper surface formed with an opening and a wall extending downward from an edge of the upper surface for transmitting the vibration of the bone conduction vibrating means and the air vibration of the air conduction vibrating means to the hearing impaired.

12. An audio listening device in accordance with claim 10, wherein said air conduction vibrating means is a damper having a central perforation into which said vibration source is fitted and secured, and generating air vibration due to vibration of said vibration source.

13. An audio listening device in accordance with claim 10, wherein said bone conduction vibrating means includes:

a cross-shaped vibration plate having a central perforation into which said vibration source is fitted and secured said cross-shaped vibration plate being connected between the inner wall surface of the housing and said vibration source so that said cross-shaped vibration plate transmits vibration caused by said vibration source to said housing; and a vibration transmission means connected to the housing and installed over the vibration source for transmitting vibration caused by said vibration source for bone conduction hearing, and wherein said vibration transmission means has an opening at its center axis for transmitting air vibration caused by said vibration source.

* * * * *